US006027223A

United States Patent [19]

Lakey et al.

[11] Patent Number: 6,027,223

[45] Date of Patent: Feb. 22, 2000

[54] WRITING INSTRUMENT POCKET CLIP LIGHT

[76] Inventors: Mark A. Lakey; Denise R. Lakey, both of P.O. Box 848, Village Mills, Tex. 77663

[21] Appl. No.: 09/258,327

[22] Filed: Feb. 25, 1999

[51] Int. Cl.[7] ..... B43K 29/10

[52] U.S. Cl. ..... 362/118; 362/191; 362/396

[58] Field of Search ..... 362/118, 191, 362/396

[56] References Cited

U.S. PATENT DOCUMENTS 4,799,132 1/1989 Perlsweig ..... 362/118

5,448,459 9/1995 Rogers ..... 362/191

5,845,985 12/1998 Xiong et al. ..... 362/118

*Primary Examiner*—Stephen Husar

[57] ABSTRACT

A writing instrument pocket clip light for providing a light from a writing instrument on to a writing surface. The writing instrument pocket clip light includes an elongate clip portion designed for attachment to a writing instrument. An elongate stem is pivotally coupled to the clip portion. A light base is coupled to the stem. The light base has a depression therein. A cover lens covers the depression of the light base. A battery is disposed in the depression of the light source. A light source is mounted to the cover lens and disposed between the cover lens and the light base. The light source is electrically connected to the battery.

9 Claims, 3 Drawing Sheets

WRITING INSTRUMENT POCKET CLIP LIGHT

BACKGROUND OF THE INVENTION

1. Field of the Invention

The present invention relates to writing instrument accessories and more particularly pertains to a new writing instrument pocket clip light for providing a light from a writing instrument on to a writing surface.

2. Description of the Prior Art

The use of writing instrument accessories is known in the prior art. More specifically, writing instrument accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,890,204 by Lin et al.; U.S. Pat. No. 3,384,742 by Delligatti; U.S. Pat. No. 2,964,614 by Buschle; U.S. Pat. No. 2,663,791 by Hettrick; U.S. Pat. No. 1,996,563 by Billings; and U.S. Pat. No. 370,497 by Moore et al.

While these devices fulfill their respective, particular objectives and requirements, the aforementioned patents do not disclose a new writing instrument pocket clip light. The inventive device includes an elongate clip portion designed for attachment to a writing instrument. An elongate stem is pivotally coupled to the clip portion. A light base is coupled to the stem. The light base has a depression therein. A cover lens covers the depression of the light base. A battery is disposed in the depression of the light source. A light source is mounted to the cover lens and disposed between the cover lens and the light base. The light source is electrically connected to the battery.

In these respects,.the writing instrument pocket clip light according to the present invention substantially departs from the conventional concepts and designs of the prior art, and in so doing provides an apparatus primarily developed for the purpose of providing a light from a writing instrument on to a writing surface.

SUMMARY OF THE INVENTION

In view of the foregoing disadvantages inherent in the known types of writing instrument accessories now present in the prior art, the present invention provides a new writing instrument pocket clip light construction wherein the same can be utilized for providing a light from a writing instrument on to a writing surface.

The general purpose of the present invention, which will be described subsequently in greater detail, is to provide a new writing instrument pocket clip light apparatus and method which has many of the advantages of the writing instrument accessories mentioned heretofore and many novel features that result in a new writing instrument pocket clip light which is not anticipated, rendered obvious, suggested, or even implied by any of the prior art writing instrument accessories, either alone or in any combination thereof.

To attain this, the present invention generally comprises an elongate clip portion designed for attachment to a writing instrument. An elongate stem is pivotally coupled to the clip portion. A light base is coupled to the stem. The light base has a depression therein. A cover lens covers the depression of the light base. A battery is disposed in the depression of the light source. A light source is mounted to the cover lens and disposed between the cover lens and the light base. The light source is electrically connected to the battery.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new writing instrument pocket clip light apparatus and method which has many of the advantages of the writing instrument accessories mentioned heretofore and many novel features that result in a new writing instrument pocket clip light which is not anticipated, rendered obvious, suggested, or even implied by any of the prior art writing instrument accessories, either alone or in any combination thereof.

It is another object of the present invention to provide a new writing instrument pocket clip light which may be easily and efficiently manufactured and marketed.

It is a further object of the present invention to provide a new writing instrument pocket clip light which is of a durable and reliable construction.

An even further object of the present invention is to provide a new writing instrument pocket clip light which is susceptible of a low cost of manufacture with regard to both materials and labor, and which accordingly is then susceptible of low prices of sale to the consuming public, thereby making such writing instrument pocket clip light economically available to the buying public.

Still yet another object of the present invention is to provide a new writing instrument pocket clip light which provides in the apparatuses and methods of the prior art some of the advantages thereof, while simultaneously overcoming some of the disadvantages normally associated therewith.

Still another object of the present invention is to provide a new writing instrument pocket clip light for providing a light from a writing instrument on to a writing surface.

Yet another object of the present invention is to provide a new writing instrument pocket clip light which includes an elongate clip portion designed for attachment to a writing instrument. An elongate stem is pivotally coupled to the clip portion. A light base is coupled to the stem. The light base has a depression therein. A cover lens covers the depression of the light base. A battery is disposed in the depression of the light source. A light source is mounted to the cover lens and disposed between the cover lens and the light base. The light source is electrically connected to the battery.

Still yet another object of the present invention is to provide a new writing instrument pocket clip light that provides a convenient location for having a light source so that a user can seen in low light conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
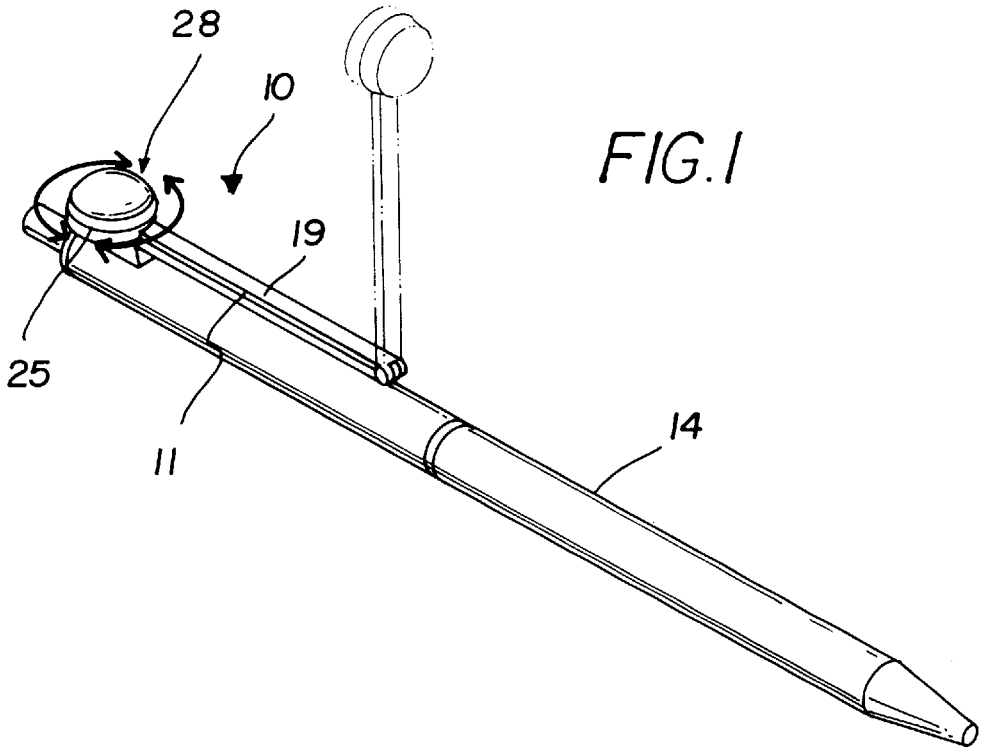
FIG. 1 is a schematic perspective view of a new writing instrument pocket clip light directly attached to a writing instrument according to the present invention and illustrating the folded and deployed positions of the stem.

With reference now to the drawings, and in particular to FIGS. 1 through 5 thereof, a new writing instrument pocket clip light embodying the principles and concepts of the present invention and generally designated by the reference numeral 10 will be described.

As best illustrated in FIGS. 1 through 5, the writing instrument pocket clip light 10 generally comprises an elongate clip portion designed for attachment to a writing instrument. An elongate stem is pivotally coupled to the clip portion. A light base is coupled to the stem. The light base has a depression therein. A cover lens covers the depression of the light base. A battery is disposed in the depression of the light source. A light source is mounted to the cover lens and disposed between the cover lens and the light base. The light source is electrically connected to the battery.

In closer detail, the writing instrument pocket clip light 10 comprises an elongate clip portion 11 with a pair of opposite ends 12, 13 and a longitudinal axis extending between the ends of the clip portion. Preferably, the clip portion has a generally rectangular transverse cross section taken substantially perpendicular to the longitudinal axis of the clip portion. A first of the ends 12 of the clip portion is designed for attachment to an elongate item such as a writing instrument 14 (as illustrated in FIG. 1) such that clip portion is spaced apart from the writing instrument and the longitudinal axis of the clip is extended generally parallel to the writing instrument.

Figure 2:
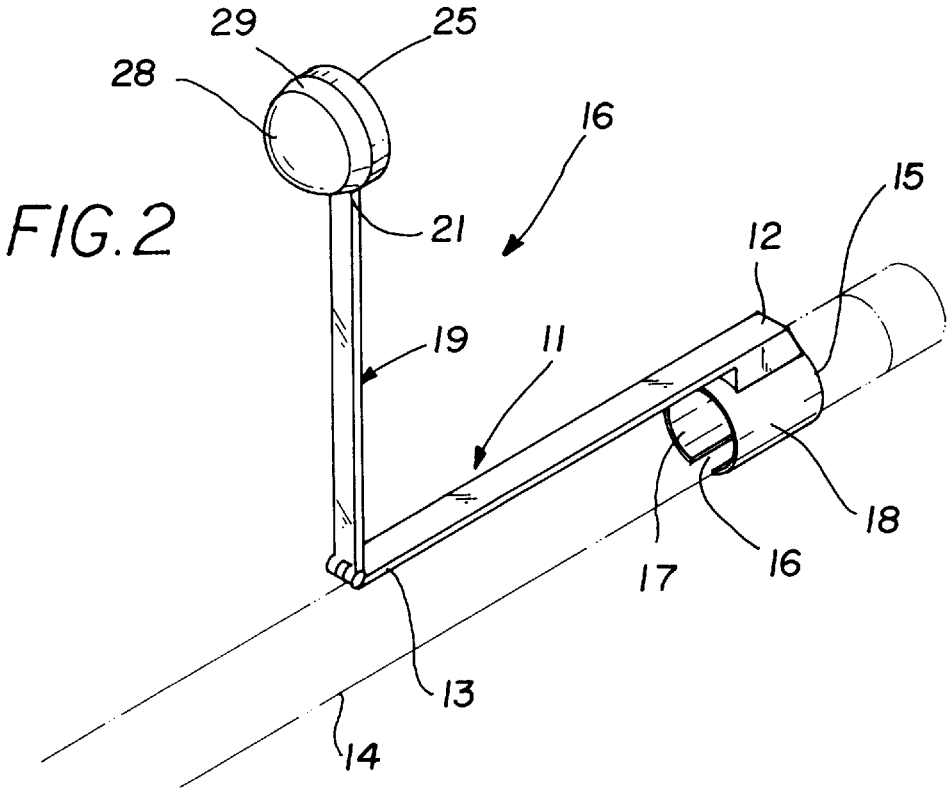
FIG. 2 is a schematic perspective view of an embodiment of the present invention having an attachment ring to attach the clip portion to a writing instrument. The stem is positioned in a deployed position.

With reference to FIG. 2, in one preferred embodiment, an attachment ring 15 is coupled to the first end of the clip portion. In use, the attachment ring is designed for extending an elongate item such as a writing instrument therethrough to mount first end of the clip portion to the writing instrument. The attachment ring has a longitudinal break 16 therethrough defining a pair of generally C-shaped opposing arcuate arms 17,18. The arcuate arms of the attachment ring each ideally comprise a resiliently deflectable material such that deflection by an item such as a writing instrument extended through the attachment ring produces an opposing biasing force by the arcuate arms such that the writing instrument is held between the arcuate arms of the attachment ring.

An elongate stem 19 has a pair of opposite ends 20, 21 and a longitudinal axis extending between the ends of the stem. A first of the ends 20 of the stem is pivotally coupled by a hinge coupling to a second of the ends 13 of the clip portion to permit pivoting of the stem between folded and deployed positions. In use, the longitudinal axes of the clip portion and the stem are generally parallel when the stem is in the folded position. The stem is preferably positionable in a deployed position where the longitudinal axis of the stem is extended generally perpendicular to the longitudinal axis of the clip portion.

Figure 5:
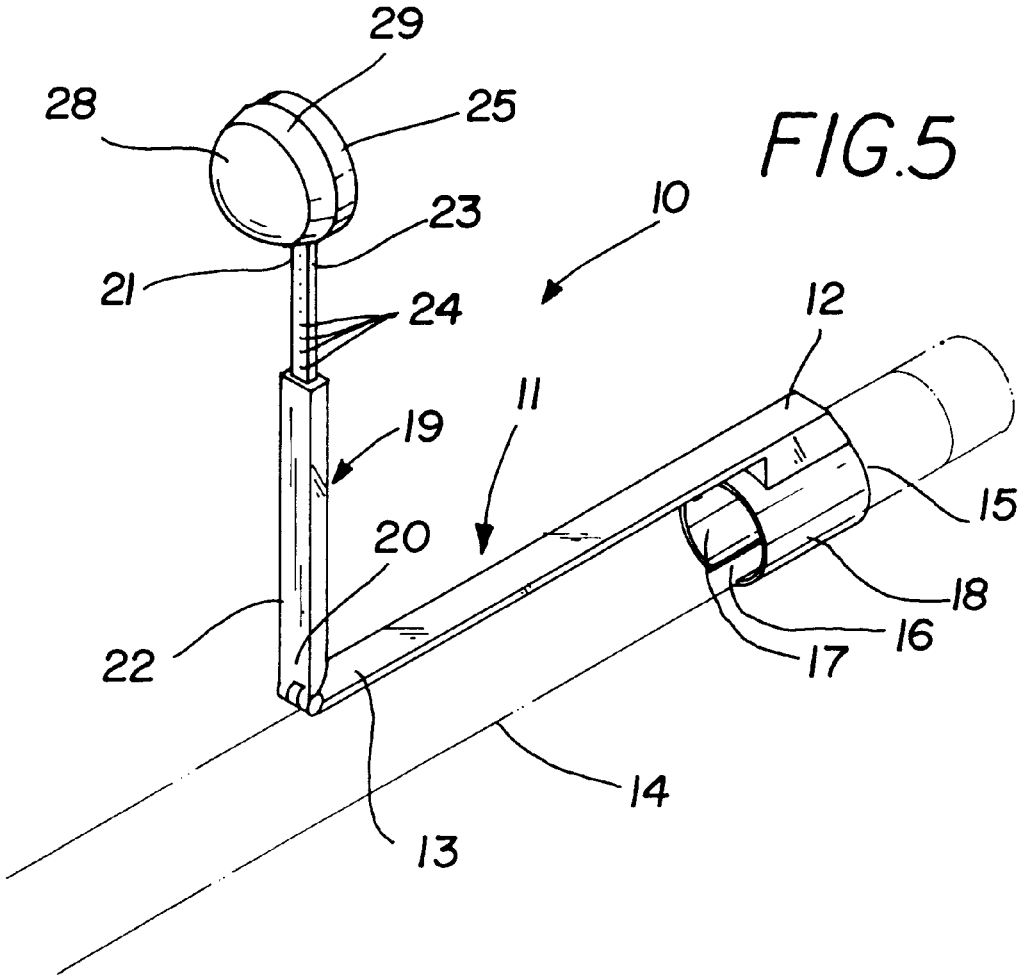
FIG. 5 is a schematic perspective view of an ideal embodiment of the present invention having a telescopically extendable stem.

In an idea embodiment, the stem is telescopically extendable in a direction parallel to the longitudinal axis of the stem as illustrated in FIG. 5. In this idea embodiment, the stem preferably comprises a pair of telescopic portions 22, 23. A first of the telescopic portions 22 is positioned adjacent the first end of the stem. A second of the telescopic portions 23 of the stem is slidably inserted into the first telescopic portion to permit telescopic extension and retraction of the stem.

The telescopic portions may be held in a releasable position with respect to one another by friction between the telescopic portions. As illustrated in FIG. 5, the second telescopic portion may instead have a plurality of spaced apart pits 24 arranged in a row extending parallel to the longitudinal axis of the stem. In this embodiment, the first telescopic portion has a detent that is removably inserted into one of the pits to releasably hold the first and second telescopic portions in a fixed position with respect to one another.

Figure 3:
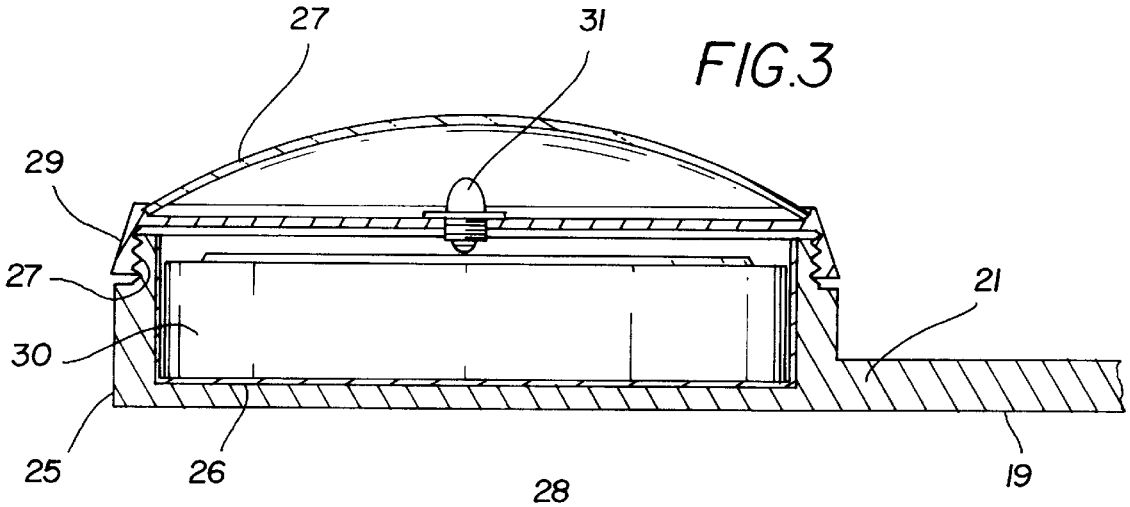
FIG. 3 is a schematic cross sectional view of the light base and cover lens region.
Figure 4:
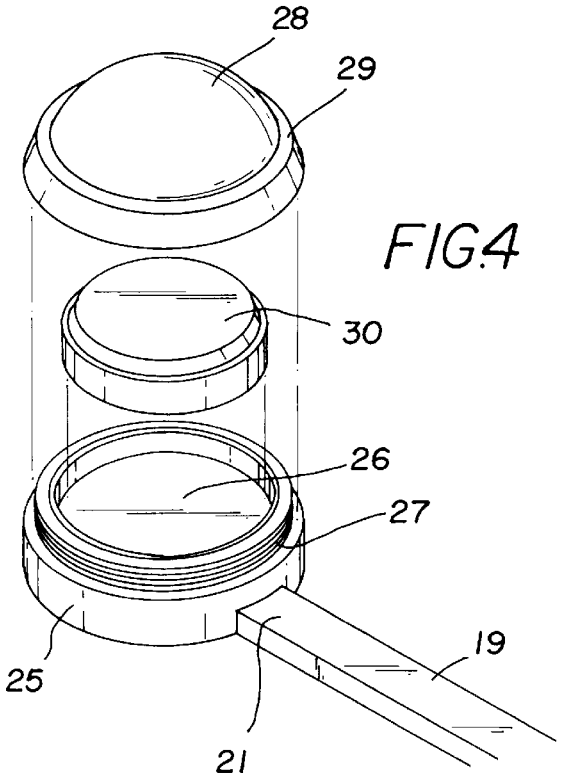
FIG. 4 is a schematic exploded perspective view of the light base and cover lens region of the present invention.

A generally disk-shaped light base 25 is coupled to a second of the ends 21 of the stem. With reference to FIG. 4, the light base has a depression 26 therein and a threaded periphery 27 extending around the depression of the light base. A generally dome-shaped cover lens 28 substantially covers the depression of the light base. The cover lens has a threaded twist ring 29 extending therearound. As best illustrated in FIG. 3, the twist ring is threadedly coupled on to the threaded periphery of the light base to detachably couple the cover lens to the light base.

A battery 30 is disposed in the depression of the light source between the light base and the cover lens so that the battery is covered by the cover lens. A light source 31 is mounted to the cover lens and disposed between the cover lens and the light base. The light source is electrically connected to the battery such that the battery supplies energy to illuminate the light source. The cover lens comprises a translucent or transparent material to permit the shinning of light from the light source through the cover lens.

In use, the twist ring is rotatable in opposite first and second directions on the threaded periphery of the light housing. Rotation of the twist ring in the first direction advances the twist ring on the threaded periphery such that the light source is in electrical contact with the battery to electrically connect the light source to the battery so that the light source energized to provide light. Conversely, rotation of the twist ring in the second direction retreats the twist ring off of the threaded periphery such that the light source is spaced apart from the battery so that the electrically connection between the light source and the battery is broken or open.

In an ideal illustrative embodiment, the stem has an extended length of about 3½ inches defined between the ends of the stem when the telescopic portions are furthest extended from one another. In this illustrative embodiment, the clip portion ideally has a width defined perpendicular to the longitudinal axis of the clip portion of about ¼ inch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. In combination:

an elongate clip portion adapted for attachment to a writing instrument;

an elongate stem being pivotally coupled to said clip portion;

a light base being coupled to said stem;

said light base having a depression therein;

a cover lens covering said depression of said light base;

a battery being disposed in said depression of said light source; and a light source being mounted to said cover lens and disposed between said cover lens and said light base, said light source being electrically connected to said battery.

2. The combination of claim 1, wherein of said clip portion has a generally rectangular transverse cross section taken substantially perpendicular to a longitudinal axis of said clip portion.

3. The combination of claim 1, further comprising an attachment ring coupled to said clip portion, said attachment ring being adapted for extending a writing instrument therethrough to attach said clip portion to the writing instrument.

4. The combination of claim 3, wherein said attachment ring has a longitudinal break therethrough defining a pair of generally C-shaped opposing arcuate arms.

5. The combination of claim 1, wherein said stem is telescopically extendable.

6. The combination of claim 5, wherein said stem comprises a pair of telescopic portions, one of said telescopic portions of said stem being slidably inserted into the other of said telescopic portions to permit telescopic extension and retraction of said stem.

7. The combination of claim 6, wherein one of said telescopic portions has a plurality of spaced apart pits, and wherein the other of said telescopic portions has a detent being removably inserted into one of said pits to releasably hold said telescopic portions in a fixed position with respect to one another.

8. The combination of claim 1, wherein said light base has a threaded periphery extending around said depression of said light base, wherein said cover lens has a threaded twist ring extending therearound, said twist ring being threadedly coupled said threaded periphery of said light base to couple said cover lens to said light base.

9. In combination:

a writing instrument;

an elongate clip portion having a pair of opposite ends and a longitudinal axis extending between said ends of said clip portion;

said clip portion having a generally rectangular transverse cross section taken substantially perpendicular to said longitudinal axis of said clip portion;

an attachment ring being coupled to a first of said ends of said clip portion, said writing instrument being extended through said attachment ring, said clip portion being spaced apart and extended generally parallel to said writing instrument;

said attachment ring having a longitudinal break therethrough defining a pair of generally C-shaped opposing arcuate arms;

said arcuate arms of said attachment ring each comprising a resiliently deflectable material such that deflection by said writing instrument extended through said attachment ring produces an opposing biasing force by said arcuate arms such that the writing instrument is held between said arcuate arms of said attachment ring;

an elongate stem having a pair of opposite ends and a longitudinal axis extending between said ends of said stem;

a first of said ends of said stem being pivotally coupled to a second of said ends of said clip portion;

said stem being telescopically extendable in a direction parallel to said longitudinal axis of said stem;

said stem comprising a pair of telescopic portions, a first of said telescopic portions being positioned adjacent said first end of said stem, a second of said telescopic portions of said stem being slidably inserted into said first telescopic portion to permit telescopic extension and retraction of said stem;

wherein said second telescopic portion has a plurality of spaced apart pits arranged in a row extending parallel to said longitudinal axis of said stem;

said first telescopic portion having a detent being removably inserted into one of said pits to releasably hold said first and second telescopic portions in a fixed position with respect to one another;

a generally disk-shaped light base being coupled to a second of said ends of said stem;

said light base having a depression therein and a threaded periphery extending around said depression of said light base;

a generally dome-shaped cover lens substantially covering said depression of said light base, said cover lens having a threaded twist ring extending therearound, said twist ring being threadedly coupled said threaded periphery of said light base to couple said cover lens to said light base;

a battery being disposed in said depression of said light source; and a light source being mounted to said cover lens and disposed between said cover lens and said light base, said light source being electrically connected to said battery.

* * * * *